US010770049B2

(12) United States Patent
Ogawa et al.

(10) Patent No.: US 10,770,049 B2
(45) Date of Patent: Sep. 8, 2020

(54) KEYBOARD APPARATUS

(71) Applicant: YAMAHA CORPORATION, Hamamatsu-shi (JP)

(72) Inventors: Kento Ogawa, Funabashi (JP); Shunsuke Ichiki, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/253,456

(22) Filed: Jan. 22, 2019

(65) Prior Publication Data

US 2019/0156804 A1 May 23, 2019

Related U.S. Application Data

(63) Continuation of application No. PCT/JP2017/024725, filed on Jul. 5, 2017.

(30) Foreign Application Priority Data

Jul. 22, 2016 (JP) ..... 2016-144492

(51) Int. Cl.
*G10C 3/12* (2006.01)
*G10H 1/34* (2006.01)

(52) U.S. Cl.
CPC ..... *G10H 1/346* (2013.01); *G10C 3/12* (2013.01); *G10H 1/34* (2013.01); *G10H 2220/275* (2013.01)

(58) Field of Classification Search
CPC .... G10H 1/346; G10H 2220/275; G10H 1/34; G10C 3/12
See application file for complete search history.

(56) References Cited

U.S. PATENT DOCUMENTS 4,860,630 A * 8/1989 Franz ..... G10C 3/12 84/439
2019/0156805 A1 5/2019 Ogawa

FOREIGN PATENT DOCUMENTS

JP H0511746 A 1/1993
JP H09230866 A 9/1997
(Continued)

OTHER PUBLICATIONS

International Search Report issued in Intl. Appln. No. PCT/JP2017/024725 dated Sep. 26, 2017. English translation provided.
(Continued)

*Primary Examiner* — Kimberly R Lockett
(74) *Attorney, Agent, or Firm* — Rossi, Kimms & McDowell LLP

(57) ABSTRACT

A keyboard apparatus includes: a key disposed to be pivotable with respect to a frame; a hammer assembly disposed to be pivotable in response to pivotal movement of the key; a first member; a second member disposed to be slid and moved on the first member when the hammer assembly pivots in response to pivotal movement of the key; and a third member connected to the first member and configured to guide the second member such that the second member is not located at a distance greater than or equal to a predetermined distance from the first member, the third member having a shape in which a second contact area that is an area of contact between the second member and the third member is less than a first contact area that is an area of contact between the first member and the second member.

23 Claims, 11 Drawing Sheets

(56) References Cited

FOREIGN PATENT DOCUMENTS

| | | | |
|---|---|---|---|
| JP | 2000352978 | A | 12/2000 |
| JP | 2004226687 | A | 8/2004 |
| JP | 2004252246 | A | 9/2004 |
| JP | 2009003102 | A | 1/2009 |
| JP | 2013160780 | A | 8/2013 |
| JP | 2013167790 | A | 8/2013 |
| JP | 2016027730 | A | 2/2016 |

OTHER PUBLICATIONS

Written Opinion issued in Intl. Appln. No. PCT/JP2017/024725 dated Sep. 26, 2017. English translation provided.
English Translation of International Preliminary Report on Patentability issued in Intl. Appln. No. PCT/JP2017/024725 dated Jan. 31, 2019.
International Preliminary Report on Patentability issued in Intl. Appln. No. PCT/JP2017/024724 dated Jan. 31, 2019. English translation provided.
International Search Report issued in Intl. Appln. No. PCT/JP2017/024724 dated Sep. 26, 2017. English translation provided.
Written Opinion issued in Intl. Appln. No. PCT/JP2017/024724 dated Sep. 26, 2017. English translation provided.
Office action issued in U.S. Appl. No. 16/253,511 dated Sep. 19, 2019.
Notice of Allowance issued in U.S. Appl. No. 16/253,511 dated Jan. 16, 2020.
Notice of Allowance issued in U.S. Appl. No. 16/253,511 dated Apr. 2, 2020.
Office Action issued in Japanese Appln. No. 2016-144383 dated Jun. 30, 2020. English machine translation provided.

* cited by examiner

KEYBOARD APPARATUS

CROSS REFERENCE TO RELATED APPLICATION

The present application is a continuation application of International Application No. PCT/JP2017/024725, filed on Jul. 5, 2017, which claims priority to Japanese Patent Application No. 2016-144492, filed on Jul. 22, 2016. The contents of these applications are incorporated herein by in their entirety.

BACKGROUND

The present disclosure relates to a keyboard apparatus.

In acoustic pianos, an operation of an action mechanism gives a predetermined feel (hereinafter referred to as "touch feel") to a finger of a player through a key. Acoustic pianos require an action mechanism for striking a string with a hammer. In electronic keyboard instruments, a sensor detects key pressing, enabling generation of a sound without such an action mechanism provided in the acoustic pianos. A touch feel of an electronic keyboard instrument not using any action mechanism and a touch feel of an electronic keyboard instrument using a simple action mechanism are greatly different from the touch feel of the acoustic piano. To solve this problem, a technique with a mechanism corresponding to a hammer provided in acoustic pianos is disclosed in order for electronic keyboard instruments to generate a touch feel close to that of acoustic pianos as disclosed in Patent Document 1 (Japanese Patent Application Publication No. 2004-226687). According to this technique, a sliding mechanism is used at a portion for transmitting an operation of a key to the hammer.

SUMMARY

In the sliding mechanism in the above-described technique, two plates opposed to each other are provided for the key, and a contact member slidably inserted between the two plates is provided for the hammer. In the case of this configuration, if a relationship between the size of the contact member and the distance between the plates deviates from a design value, a resisting force in sliding greatly changes. This changes a touch feel (especially, a magnitude of load on key pressing). Thus, it is required to precisely control the sizes of the components.

An object of the present disclosure is to reduce unexpected changes of a touch feel in an electronic keyboard instrument.

In one aspect of the present disclosure, a keyboard apparatus includes: a key disposed so as to be pivotable with respect to a frame; a hammer assembly disposed so as to be pivotable in response to pivotal movement of the key; a first member; a second member disposed so as to be slid and moved on the first member when the hammer assembly pivots in response to pivotal movement of the key; and a third member connected to the first member and configured to guide the second member such that the second member is not located at a distance greater than or equal to a predetermined distance from the first member, the third member having a shape in which a second contact area that is an area of contact between the second member and the third member is less than a first contact area that is an area of contact between the first member and the second member.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
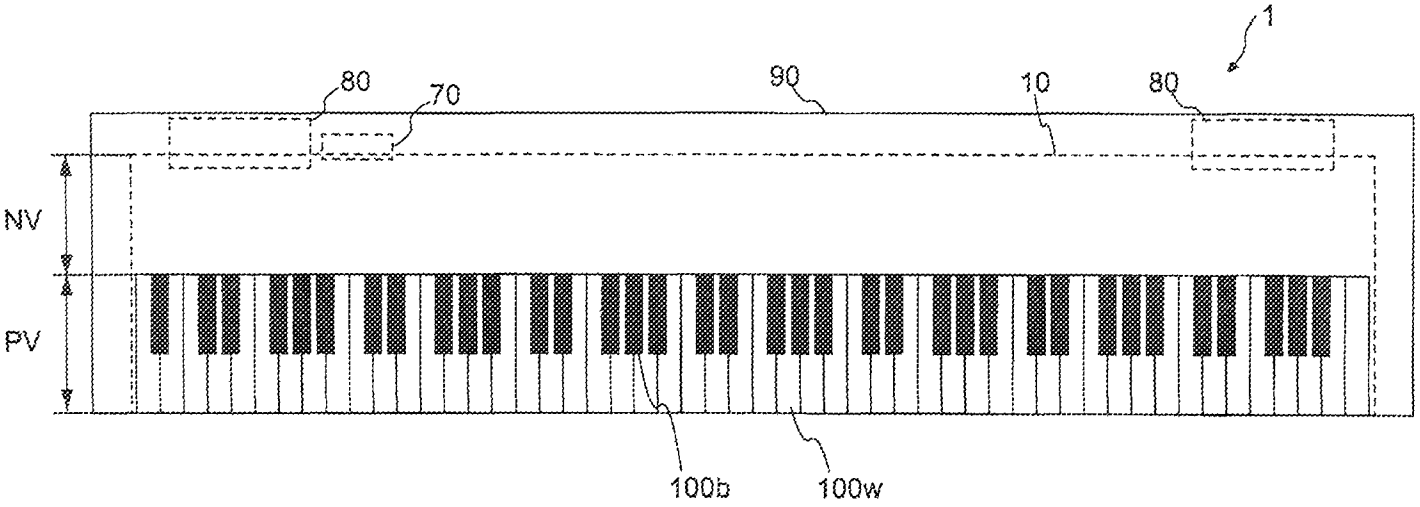
FIG. 1 is a view of a keyboard apparatus according to a first embodiment.

Hereinafter, there will be described embodiments by reference to the drawings. It is to be understood that the following embodiments are described only by way of example, and the disclosure may be otherwise embodied with various modifications without departing from the scope and spirit of the disclosure. It is noted that the same or similar reference numerals (e.g., numbers with a character, such as A or B, appended thereto) may be used for components having the same or similar function in the following description and drawings, and an explanation of which is dispensed with. The ratio of dimensions in the drawings (e.g., the ratio between the components and the ratio in the lengthwise, widthwise, and height directions) may differ from the actual ratio, and portions of components may be omitted from the drawings for easier understanding purposes.

First Embodiment

Configuration of Keyboard Apparatus

FIG. 1 is a view of a keyboard apparatus according to a first embodiment. In the present embodiment, a keyboard apparatus 1 is an electronic keyboard instrument, such as an electronic piano, configured to produce a sound when a key is pressed by a user (a player). It is noted that the keyboard apparatus 1 may be a keyboard-type controller configured to output data (e.g., MIDI) for controlling an external sound source device, in response to key pressing. In this case, the keyboard apparatus 1 may include no sound source device.

The keyboard apparatus 1 includes a keyboard assembly 10. The keyboard assembly 10 includes white keys 100*w* and black keys 100*b* arranged side by side. The number of the keys 100 is N. In the present embodiment, N is 88. A direction in which the keys 100 are arranged will be referred to as "scale direction". The white key 100*w* and the black key 100*b* may be hereinafter collectively referred to "the key 100" in the case where there is no need of distinction between the white key 100*w* and the black key 100*b*. Also in the following explanation, "w" appended to the reference number indicates a configuration corresponding to the white key. Also, "b" appended to the reference number indicates a configuration corresponding to the black key.

A portion of the keyboard assembly 10 is located in a housing 90. In the case where the keyboard apparatus 1 is viewed from an upper side thereof, a portion of the keyboard assembly 10 which is covered with the housing 90 will be referred to as "non-visible portion NV", and a portion of the keyboard assembly 10 which is exposed from the housing 90 and viewable by the user will be referred to as "visible portion PV". That is, the visible portion PV is a portion of the key 100 which is operable by the user to play the keyboard apparatus 1. A portion of the key 100 which is exposed by the visible portion PV may be hereinafter referred to as "key main body portion".

The housing 90 contains a sound source device 70 and a speaker 80. The sound source device 70 is configured to create a sound waveform signal in response to pressing of the key 100. The speaker 80 is configured to output the sound waveform signal created by the sound source device 70, to an outside space. It is noted that the keyboard apparatus 1 may include: a slider for controlling a sound volume; a switch for changing a tone color; and a display configured to display various kinds of information.

In the following description, up, down, left, right, front, and back (rear) directions (sides) respectively indicate directions (sides) in the case where the keyboard apparatus 1 is viewed from the player during playing. Thus, it is possible to express that the non-visible portion NV is located on a back side of the visible portion PV, for example. Also, directions and sides may be represented with reference to the key 100. For example, a key-front-end side (a key-front side) and a key-back-end side (a key-back side) may be used. In this case, the key-front-end side is a front side of the key 100 when viewed from the player. The key-back-end side is a back side of the key 100 when viewed from the player. According to this definition, it is possible to express that a portion of the black key 100*b* from a front end to a rear end of the key main body portion of the black key 100*b* is located on an upper side of the white key 100*w*.

Figure 2:
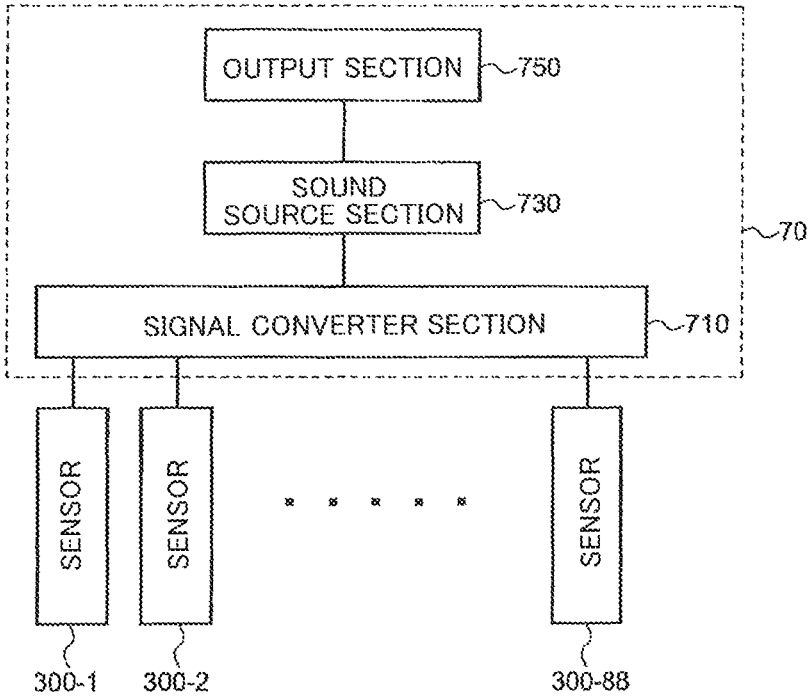
FIG. 2 is a block diagram illustrating a configuration of a sound source device in the first embodiment.

FIG. 2 is a block diagram illustrating the configuration of the sound source device in the first embodiment. The sound source device 70 includes a signal converter section 710, a sound source section 730, and an output section 750. Sensors 300 are provided corresponding to the respective keys 100. Each of the sensors 300 detects an operation of a corresponding one of the keys 100 and outputs signals in accordance with the detection. In the present example, each of the sensors 300 outputs signals in accordance with three levels of key pressing amounts. The speed of the key pressing is detectable in accordance with a time interval between the signals.

The signal converter section 710 obtains the signals output from the sensors 300 (the sensors 300-1, 300-2, . . . , 300-88 corresponding to the respective 88 keys 100) and creates and outputs an operation signal in accordance with an operation state of each of the keys 100. In the present example, the operation signal is a MIDI signal. Thus, the signal converter section 710 outputs "Note-On" when a key is pressed. In this output, a key number indicating which one of the 88 keys 100 is operated, and a velocity corresponding to the speed of the key pressing are also output in association with "Note-On". When the player has released the key 100, the signal converter section 710 outputs the key number and "Note-Off" in association with each other. A signal created in response to another operation, such as an operation on a pedal, may be output to the signal converter section 710 and reflected on the operation signal.

The sound source section 730 creates the sound waveform signal based on the operation signal output from the signal converter section 710. The output section 750 outputs the sound waveform signal created by the sound source section 730. This sound waveform signal is output to the speaker 80 or a sound-waveform-signal output terminal, for example.

Configuration of Keyboard Assembly

Figure 3:
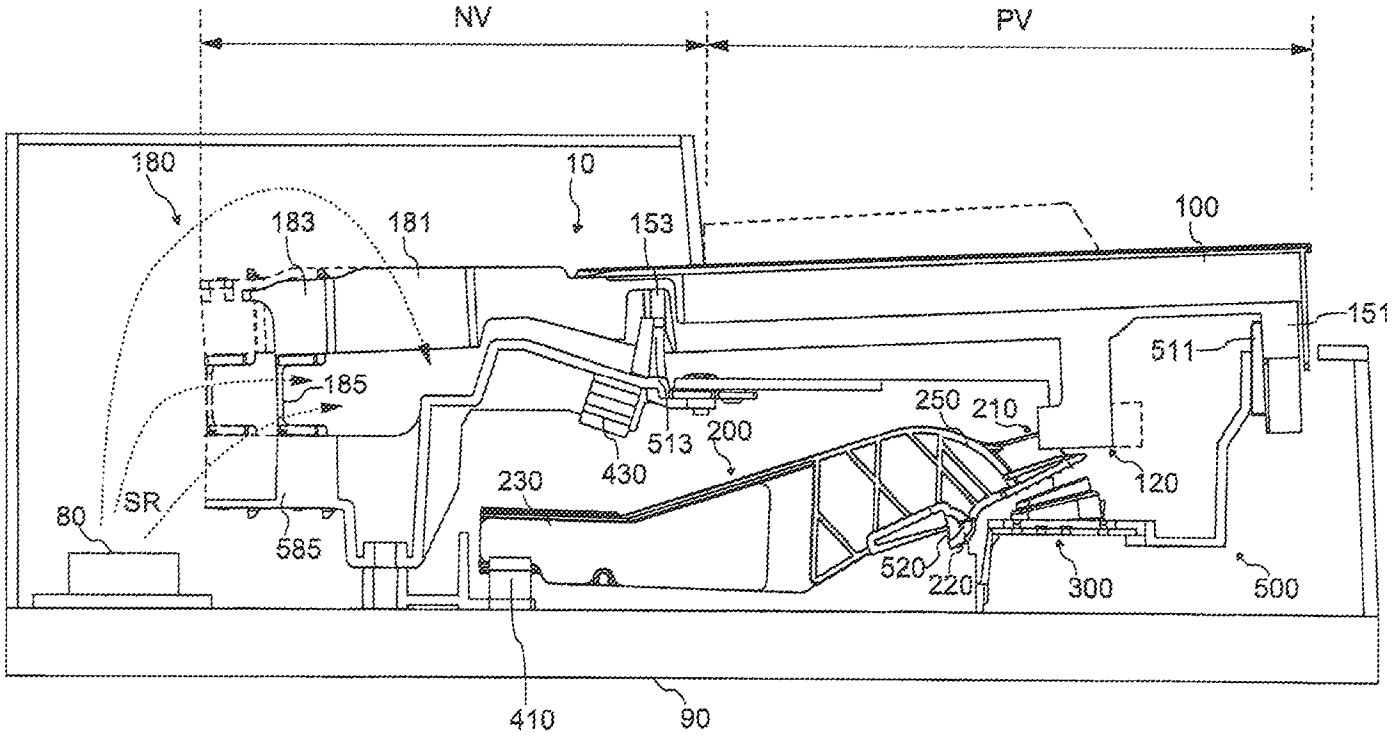
FIG. 3 is a view of a configuration of the inside of a housing in the first embodiment, with the configuration viewed from a lateral side of the housing.

FIG. 3 is a view of a configuration of the inside of the housing in the first embodiment, with the configuration viewed from a lateral side of the housing. As illustrated in FIG. 3, the keyboard assembly 10 and the speaker 80 are disposed in the housing 90. That is, the housing 90 covers at least a portion of the keyboard assembly 10 (a connecting portion 180 and a frame 500) and the speaker 80. The speaker 80 is disposed at a back portion of the keyboard assembly 10. This speaker 80 is disposed so as to output a sound, which is produced in response to pressing of the key 100, toward up and down sides of the housing 90. The sound output downward travels toward the outside from a portion of the housing 90 near its lower surface. The sound output upward passes from the inside of the housing 90 through a space in the keyboard assembly 10 and travels to the outside from a space between the housing 90 and the keys 100 or from spaces each located between adjacent two of the keys 100 at the visible portion PV. It is noted that paths SR are one example of paths of sounds output from the speaker 80 to a space formed in the keyboard assembly 10, i.e., a space under the keys 100 (the key main body portions).

There will be next described a configuration of the keyboard assembly 10 with reference to FIG. 3. In addition to the keys 100, the keyboard assembly 10 includes the connecting portion 180, a hammer assembly 200, and the frame 500. The keyboard assembly 10 is formed of resin, and a most portion of the keyboard assembly 10 is manufactured by, e.g., injection molding. The frame 500 is fixed to the housing 90. The connecting portion 180 connects the keys 100 to the frame 500 such that the keys 100 are pivotable. The connecting portion 180 includes plate-like flexible members 181, key-side supporters 183, and rod-like flexible members 185. Each of the plate-like flexible members 181 extends from a rear end of a corresponding one of the keys 100. Each of the key-side supporters 183 extends from a rear end of a corresponding one of the plate-like flexible members 181. Each of the rod-like flexible members 185 is supported by a corresponding one of the key-side supporters 183 and a frame-side supporter 585 of the frame 500. That is, each of the rod-like flexible members 185 is disposed between a corresponding one of the keys 100 and the frame 500. When the rod-like flexible member 185 is bent, the key 100 pivots with respect to the frame 500. The rod-like flexible member 185 is detachably attached to the key-side supporter 183 and the frame-side supporter 585. It is noted that the rod-like flexible member 185 may be integral with the key-side supporter 183 and the frame-side supporter 585 or bonded so as not to be attached or detached.

The key 100 includes a front-end key guide 151 and a side-surface key guide 153. The front-end key guide 151 is in slidable contact with a front-end frame guide 511 of the frame 500 in a state in which the front-end key guide 151 covers the front-end frame guide 511. The front-end key guide 151 is in contact with the front-end frame guide 511 at opposite side portions of upper and lower portions of the front-end key guide 151 in the scale direction. The side-surface key guide 153 is in slidable contact with a side-surface frame guide 513 at opposite side portions of the side-surface key guide 153 in the scale direction. In the present embodiment, the side-surface key guide 153 is disposed at portions of side surfaces of the key 100 which correspond to the non-visible portion NV, and the side-surface key guide 153 is nearer to the front end of the key 100 than the connecting portion 180 (the plate-like flexible member 181), but the side-surface key guide 153 may be disposed at a region corresponding to the visible portion PV.

A key-side load portion 120 is connected to the key 100 at a lower part of the visible portion PV. When the key 100 pivots, the key-side load portion 120 is connected to the hammer assembly 200 so as to cause pivotal movement of the hammer assembly 200.

The hammer assembly 200 is disposed at a space under the key 100 and attached so as to be pivotable with respect to the frame 500. The hammer assembly 200 includes a weight 230 and a hammer body 250. A shaft supporter 220 is disposed on the hammer body 250. The shaft supporter 220 serves as a bearing for a pivot shaft 520 of the frame 500. The shaft supporter 220 and the pivot shaft 520 of the frame 500 are held in sliding contact with each other in at least three positions.

A hammer-side load portion 210 is connected to a front end portion of the hammer body 250. The hammer-side load portion 210 has a portion in the key-side load portion 120, which portion is held in contact with the key-side load portion 120 so as to be slidable generally in the front and rear direction. The portion of the hammer-side load portion 210 is a moving member 211, which will be described below (see FIG. 4). Lubricant such as grease may be provided on this contacting portion. The hammer-side load portion 210 and the key-side load portion 120 are slid on each other to generate a portion of load when the key 100 is pressed. The hammer-side load portion 210 and the key-side load portion 120 may be hereinafter referred collectively as "load generator". The load generator in this example is located under the key 100 at the visible portion PV (in front of a rear end of the key main body portion). The configuration of the load generator will be described later in detail.

The weight 230 has a metal weight and is connected to the rear end portion of the hammer body 250 (which is located on a back side of a pivot shaft of the hammer assembly 200). In a normal state (i.e., a state in which the key 100 is not pressed), the weight 230 is placed on a lower stopper 410, resulting in the key 100 stably kept at a rest position. When the key 100 is pressed, the weight 230 moves upward and collides against an upper stopper 430. This defines an end position corresponding to the maximum pressing amount of the key 100. This weight 230 also imposes load on pressing of the key 100. The lower stopper 410 and the upper stopper 430 are formed of a cushioning material such as a nonwoven fabric and a resilient material, for example.

Below the load generator, the sensors 300 are mounted on the frame 500. When the sensor 300 is pressed and deformed under a lower surface of the hammer-side load portion 210 in response to pressing of the key 100, the sensor 300 outputs a detection signal. As described above, the sensors 300 correspond respectively to the keys 100.

Configuration of Load Generator

Figure 4:
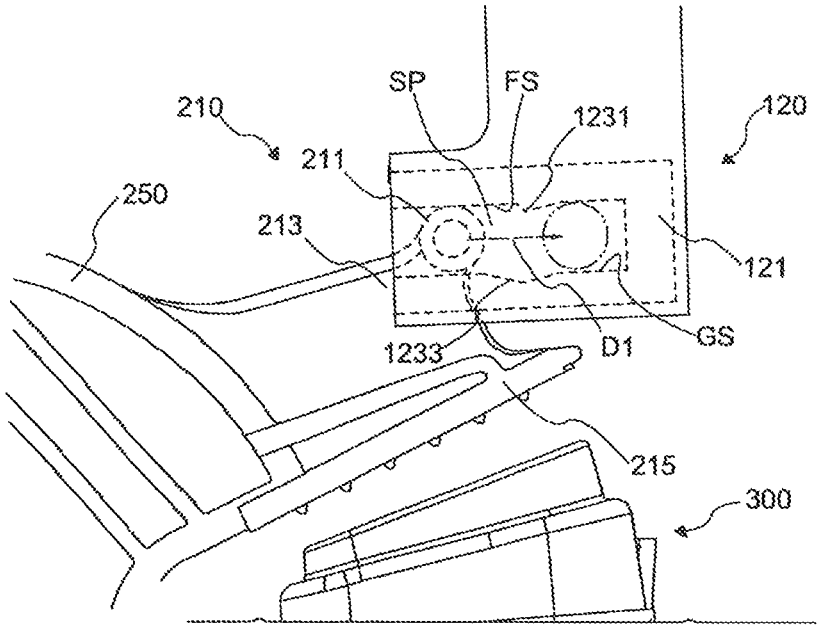
FIG. 4 is a view for explaining a load generator (a key-side load portion and a hammer-side load portion) in the first embodiment.

FIG. 4 is a view for explaining the load generator (the key-side load portion and the hammer-side load portion) in the first embodiment. The hammer-side load portion 210 includes the moving member 211 (as one example of a second member), a rib 213, and a sensor driving member 215 as a plate member. These components are also connected to the hammer body 250. The moving member 211 has a substantially circular cylindrical shape in this example, and the axis of the moving member 211 extends in the scale direction. The rib 213 is connected to a lower portion of the moving member 211. In this example, the direction of the normal to a surface of the rib 213 extends along the scale direction. The sensor driving member 215 is a plate member connected to a lower portion of the rib 213. The direction of the normal to a surface of the sensor driving member 215 is perpendicular to the scale direction. That is, the sensor driving member 215 and the rib 213 are perpendicular to each other. Here, the surface of the rib 213 contains a direction in which the rib 213 is moved by pressing of the key 100. This increases the respective strengths of the moving member 211 and the sensor driving member 215 in a direction in which the moving member 211 and the sensor driving member 215 are moved when the key 100 is pressed. Here, the rib 213 and the sensor driving member 215 serve as a reinforcement for the moving member 211. The moving member 211 and the rib 213 serve as a reinforcement for the sensor driving member 215. With this configuration, the components are reinforced with each other and made strong as a whole when compared with a configuration in which the rib is merely provided. It is noted that, as illustrated in FIG. 4, the moving member 211 is connected to the front end portion of the hammer body 250 via the rib 213. As described above, the weight 230 is connected to the rear end portion of the hammer body 250 (which is located on a back side of the pivot shaft of the hammer assembly 200). That is, the moving member 211 is located on an opposite side of the pivot shaft of the hammer assembly 200 from the weight 230. In other words, the moving member 211 is located on a front side of the pivot shaft of the hammer assembly 200, and the weight 230 is located on a rear side of the pivot shaft of the hammer assembly 200.

The key-side load portion 120 has a sliding-surface forming portion 121. As illustrated in FIG. 4, the sliding-surface forming portion 121 is disposed at a lower end portion of the key-side load portion 120 extending downward from the key 100. That is, the sliding-surface forming portion 121 is disposed on the key 100 at a position where the sliding-surface forming portion 121 is movable downward when the key 100 is pressed. The inside of the sliding-surface forming portion 121 has a space SP in which the moving member 211 is movable. A sliding surface FS is formed above the space SP, and a guide surface GS is formed below the space SP. In this example, a region in which at least the sliding surface FS is formed by an elastic member formed of rubber, for example. That is, this elastic member is exposed. In this example, the entire sliding-surface forming portion 121 is formed by the elastic member. This elastic member preferably has viscoelasticity. That is, the elastic member preferably is a viscoelastic member. Since the sliding-surface forming portion 121 is an elastic member, the sliding-surface forming portion 121 is surrounded by a stiff member formed of a material not easily deformed, such as resin having stiffness that is higher than that of the elastic member constituting the sliding-surface forming portion 121. With this configuration, the sliding-surface forming portion 121 is supported so as to maintain the shape of an outer surface of the sliding-surface forming portion 121. This outer surface contains a surface of the sliding-surface forming portion 121 which is opposed to the sliding surface FS. It is noted that the stiffness of the sliding-surface forming portion 121 may gradually increase in its portion extending from the sliding surface FS to the stiff member located outside the outer surface of the sliding-surface forming portion 121. This portion preferably does not contain a component that is elastically deformed more easily than the sliding surface FS, e.g., a component having lower stiffness than the sliding surface FS.

The position of the moving member 211 in FIG. 4 indicates a position when the key 100 is located at the rest position. When the key 100 is pressed, the moving member 211 moves the space SP in the direction indicated by arrow D1 (hereinafter may be referred to as "traveling direction D1") while contacting the sliding surface FS. That is, the moving member 211 is slid relative to the sliding surface FS. Since the moving member 211 moves while contacting the sliding surface FS, the sliding surface FS and the moving member 211 may be hereinafter referred to as "intermittent sliding side" and "continuous sliding side", respectively. Since the moving member 211 is also slightly rotated, and its contact surface is moved, the moving member 211 is not continuously slid strictly, but substantially continuously slid. In any case, the area of the entire portion of the sliding surface FS which is contactable by the moving member 211 in a region in which the sliding surface FS and the moving member 211 are slid in response to pressing of the key 100 is greater than that of the entire portion of the moving member 211 which is contactable by the sliding surface FS.

In response to pressing of the key 100, the entire load generator is moved downward, so that the sensor driving member 215 presses and deforms the sensor 300. In this example, a step 1231 formed in a portion of the sliding surface FS in which the moving member 211 is moved by pivotal movement of the key 100 from the rest position to the end position. That is, the moving member 211 moved from an initial position moves over the step 1231. This initial position is a position of the moving member 211 when the key 100 is located at the rest position. A recess 1233 is formed in a portion of the guide surface GS which is opposed to the step 1231. The recess 1233 makes it easy for the moving member 211 to move over the step 1231. The configuration of the sliding-surface forming portion 121 will be described below in detail.

Configuration of Sliding-Surface Forming Portion

Figure 5C:
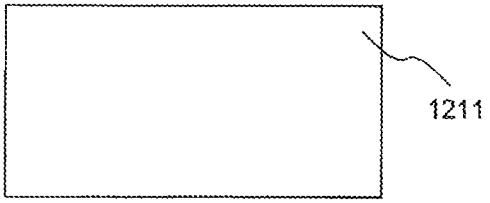
FIGS. 5A through 5E are views for explaining a configuration of a sliding-surface forming portion in the first embodiment.
Figure 5B:
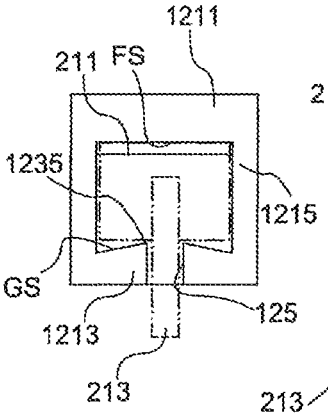
Figure 5A:
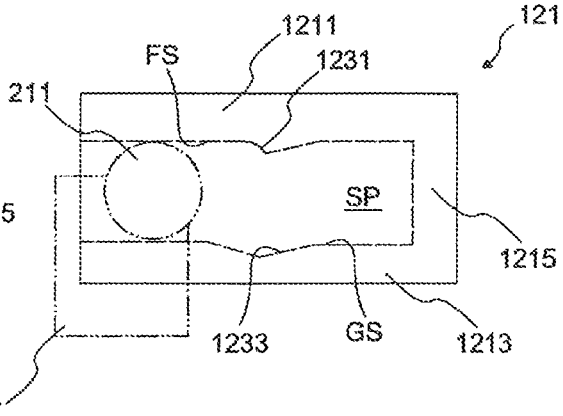
Figure 5E:
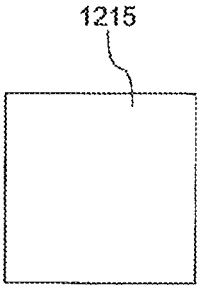
Figure 5D:
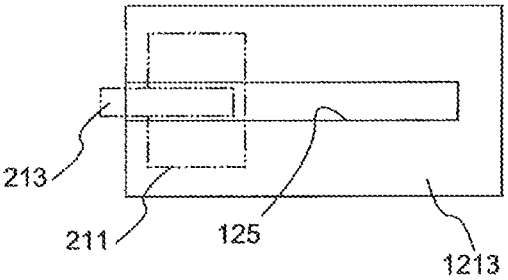

FIGS. 5A through 5E are views for explaining the configuration of the sliding-surface forming portion in the first embodiment. FIG. 5A is a view for specifically explaining the sliding-surface forming portion 121 explained above with reference to FIG. 4, and the broken line in FIG. 5A indicates a configuration in the sliding-surface forming portion 121. FIG. 5(B) is a view of the sliding-surface forming portion 121 viewed from a rear side thereof (from the key-back-end side). FIG. 5C is a view of the sliding-surface forming portion 121 viewed from an upper side thereof. FIG. 5D is a view of the sliding-surface forming portion 121 viewed from a lower side thereof. FIG. 5E is a view of the sliding-surface forming portion 121 viewed from a front side thereof (from the key-front-end side). It is noted that a region in which the moving member 211 and the rib 213 are located is indicated by the two-dot chain line.

The sliding-surface forming portion 121 includes an upper member 1211 (as one example of a first member), a lower member 1213 (as one example of a third member), and a side member 1215. The upper member 1211 and the lower member 1213 are connected to each other by the side member 1215. The space SP is surrounded by the upper member 1211, the lower member 1213, and the side member 1215. A surface of the upper member 1211 near the space SP is the sliding surface FS. The step 1231 is formed on the sliding surface FS as described above. A surface of the upper member 1211 near the space SP is the guide surface GS. The recess 1233 is formed in the guide surface GS as described above. The guide surface GS guides the moving member 211 so as to prevent the moving member 211 from being located at a distance greater than or equal to a predetermined distance, from the upper member 1211 (the sliding surface FS). That is, as illustrated in FIG. 4, the upper member 1211 is disposed under the key 100, and the lower member 1213 is disposed under the upper member 1211. The lower member 1213 is disposed such that the moving member 211 is interposed between the lower member 1213 and the upper member 1211.

The lower member 1213 has a slit 125. The rib 213 moved with the moving member 211 passes through the slit 125. Though not illustrated in FIGS. 5A-5E, as illustrated in FIG. 4, the sensor driving member 215 is connected to the rib 213 at a position located on an opposite side of the rib 213 from the moving member 211. This configuration establishes a positional relationship in which the lower member 1213 is interposed between the moving member 211 and the sensor driving member 215.

The guide surface GS of the lower member 1213 is inclined so as to be nearer to the sliding surface FS at a portion of the guide surface GS near the slit 125 than at a portion of the guide surface GS far from the slit 125. That is, the lower member 1213 includes protruding portions 1235 each having a line shape protruding along the slit 125 (along the traveling direction D1 of the moving member 211). The protruding portions 1235 protrude toward the moving member 211. The protruding portions 1235 are provided on opposite sides of the slit. Thus, the area of contact between the moving member 211 and the guide surface GS is less than that of contact between the moving member 211 and the sliding surface FS. In this example, the moving member 211 is separated from the guide surface GS (the protruding portions 1235 formed on the guide surface GS) when the moving member 211 is in contact with the sliding surface FS, and the moving member 211 is separated from the sliding surface FS when the moving member 211 is in contact with the guide surface GS (the protruding portions 1235 formed on the guide surface GS). It is noted that the moving member 211 may be slid while contacting both of the sliding surface FS and the guide surface GS, in at least a portion of a region in which the moving member 211 is movable. While the protruding portions 1235 are provided respectively on opposite sides of the slit 125 in this example, only one of the protruding portions 1235 may be provided on one of opposite sides of the slit 125.

When the key 100 is pressed, a force is applied from the sliding surface FS to the moving member 211. The force transmitted to the moving member 211 causes pivotal movement of the hammer assembly 200 so as to move the weight 230 upward. In this operation, the moving member 211 is pressed downward against the sliding surface FS by the sliding-surface forming portion 121 and moved in the traveling direction D1 with respect to the sliding surface FS. When the key 100 is released, the weight 230 falls downward, which causes pivotal movement of the hammer assembly 200, so that an upward force is applied from the moving member 211 to the sliding surface FS. Here, the moving member 211 is formed of a material less easily deformed than that of the elastic member forming the sliding surface FS, such as resin having higher stiffness than the elastic member forming the sliding surface FS. Thus, when the moving member 211 is pressed against the sliding surface FS, the sliding surface FS is elastically deformed. As a result, movement of the moving member 211 receives various resisting forces in accordance with a force by which the moving member 211 is pressed. These resisting forces will be described with reference to FIGS. 6 and 7.

Figure 6:
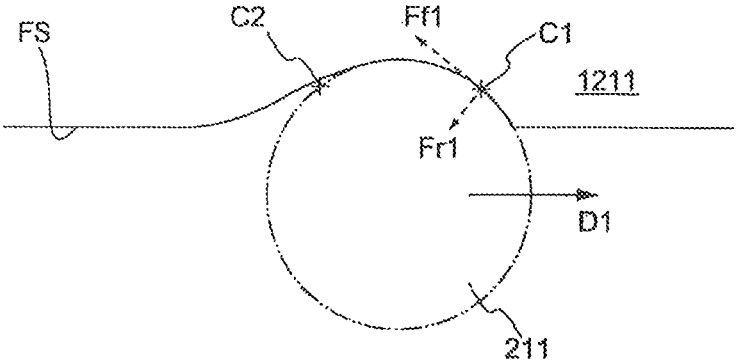
FIG. 6 is a view for explaining elastic deformation of an elastic member in the first embodiment (when a key is strongly struck)
Figure 7:
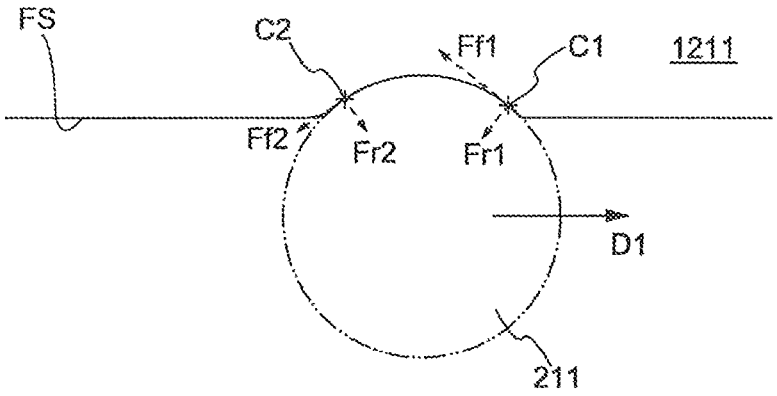
FIG. 7 is a view for explaining elastic deformation of the elastic member in the first embodiment (when a key is weakly struck)

FIG. 6 is a view for explaining elastic deformation of the elastic member in the first embodiment when the key 100 is strongly struck. FIG. 7 is a view for explaining elastic deformation of the elastic member in the first embodiment when the key 100 is weakly struck. When the key 100 is pressed, the moving member 211 is moved in the traveling direction D1. In this movement, since the moving member 211 is pressed against the sliding surface FS of the upper member 1211, the upper member 1211 formed of an elastic material is deformed by its elastic deformation such that the sliding surface FS is recessed.

At the point C1 located on a traveling-direction-D1-side portion of a surface of the moving member 211 (hereinafter may be referred to as "front portion of the moving member 211"), not only a frictional force Ff1 that is a force of friction with the upper member 1211 but also a reactive force Fr1 that is a force by which the moving member 211 is pressed back by the upper member 1211 acts as a resisting force against movement of the moving member 211 in the traveling direction D1. At the point C2 located on a portion of the surface of the moving member 211 which portion is located on an opposite side of the center of the moving member 211 from the traveling-direction-D1-side portion (hereinafter may be referred to as "rear portion of the moving member 211"), the moving member 211 contacts the upper member 1211 when the key 100 is weakly pressed or struck, but the moving member 211 does not contact the upper member 1211 when the key 100 is strongly pressed or struck (see FIG. 6).

The upper member 1211 is elastically deformed by the moving member 211. After the moving member 211 passes through the upper member 1211, the shape of the upper member 1211 is restored to its original shape. When the key 100 is strongly struck, the moving member 211 is moved earlier than the restoration. Thus, a region in which the moving member 211 and the upper member 1211 are not in contact with each other increases in the rear portion of the moving member 211. The region in which the moving member 211 and the upper member 1211 are not in contact with each other increases with increase in viscosity of the upper member 1211 even in the case of the same speed of movement of the moving member 211.

It is noted that a difference between weak strike and strong strike, i.e., a difference in force of pressing of the key 100 affects the degree of elastic deformation. A difference between weak strike and strong strike in the size of the region in which the moving member 211 and the upper member 1211 are not in contact with each other is caused directly by the speed of movement of the moving member 211, specifically. That is, in the case where the speed of key pressing has already increased even if a force of the key pressing is weak, the region in which the moving member 211 and the upper member 1211 are not in contact with each other increases. For example, in the case where the player presses the key 100 while bringing his or her hands down, a force acting on the key 100 is large at the start of the key pressing but decreases immediately, and thereby an amount of elastic deformation decreases, so that the moving member 211 moves at a substantially uniform speed. Since the speed of movement of the moving member 211 is still high, it is difficult for the upper member 1211 to receive a force from the rear portion of the moving member 211 by the effect of the viscosity of the upper member 1211, and the upper member 1211 is greatly affected by the reactive force Fr1 applied from the front portion of the moving member 211, which produces a resisting force against the key pressing.

In the case where the rear portion of the moving member 211 contacts the upper member 1211, the moving member 211 receives not only a frictional force Ff2 but also a reactive force Fr2. The frictional force Ff2 is a resisting force against the traveling direction D1. The reactive force Fr2 is a thrust force for the traveling direction D1. Also, an amount of elastic deformation of the upper member 1211 decreases with decrease in strength of key striking. Thus, the magnitude of the reactive force Fr1 is small, and the area of contact between the moving member 211 and the upper member 1211 is small as a whole, so that the magnitude of the frictional force also decreases. Thus, not only the frictional force but also effects caused by the reactive force are different between the situations in FIGS. 6 and 7. With these configurations, the strength and speed of key pressing enable complicated changes of the resisting force to be received by the moving member 211 in the traveling direction D1. The resisting force received by the moving member 211 also serves as a resisting force to be applied to key pressing. This reproduces changes of the resisting force applied to key pressing in accordance with the strength and speed of key pressing in an acoustic piano. It is also possible to achieve various designs of the resisting force applied to key pressing, by forming the upper member 1211 with a material in which elasticity greatly affected by acceleration (a force of key pressing) and viscosity greatly affected by speed (the speed of key pressing) are adjusted.

It is noted that, when the key 100 has reached the end position, the moving member 211 in some cases bounds to the sliding surface FS and collides against the guide surface GS, depending upon the strength of key pressing. In this case, the protruding portions 1235 of the guide surface GS may be elastically deformed so as to be pressed and deformed by the moving member 211. Due to the presence of the protruding portions 1235, the area of contact between the moving member 211 and the guide surface GS (a second contact area) is less than that of contact between the moving member 211 and the sliding surface FS (a first contact area). Thus, the guide surface GS is elastically deformed more easily than the sliding surface FS even in the case where a force of the same magnitude is applied. Accordingly, even in the case where the moving member 211 collides against the guide surface GS, a smaller collision sound is produced than in the case where the moving member 211 collides against the sliding surface FS. It is noted that, as illustrated in FIG. 5B, when the moving member 211 is in contact with the guide surface GS and slid on the guide surface GS, the moving member 211 is in contact with the protruding portions 1235 without being in contact with the entire guide surface GS. Accordingly, it is possible to consider that depressed portions are formed in the guide surface GS in the first embodiment. These depressed portions are depressed away from the moving member 211 and extend along the traveling direction D.

Operations of Keyboard Assembly

Figure 8A:
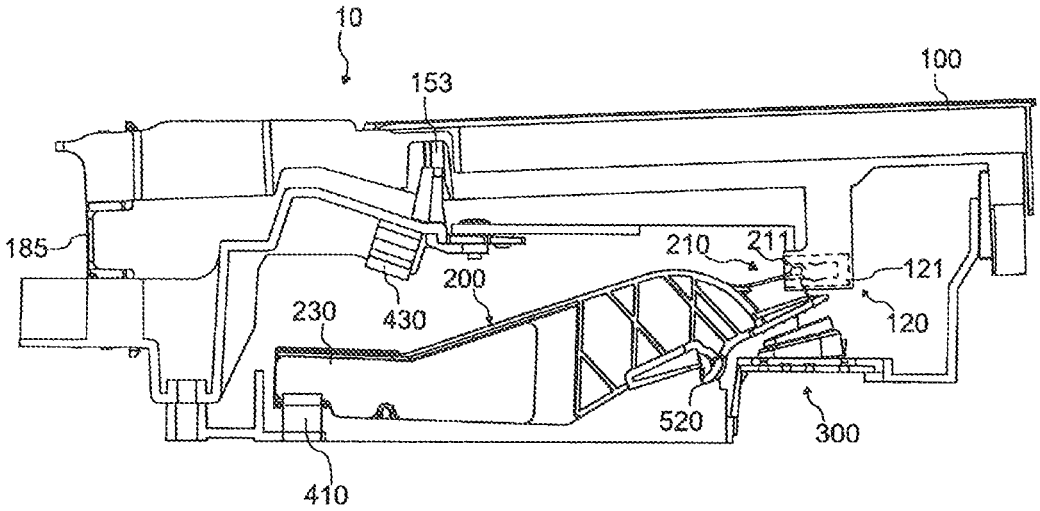
FIGS. 8A and 8B are views for explaining operations of a keyboard assembly when a key (a white key) is depressed in the first embodiment.
Figure 8B:
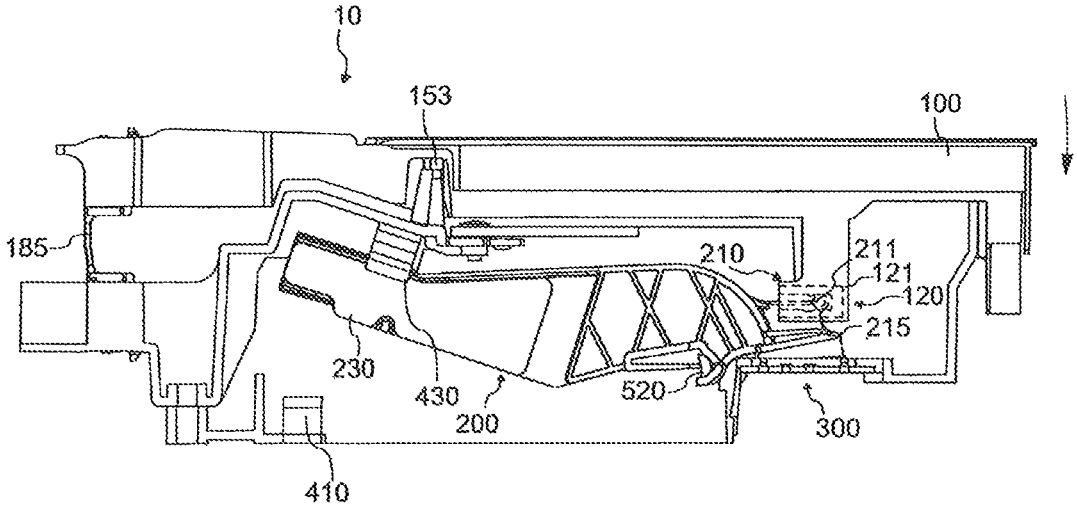

FIGS. 8A and 8B are views for explaining operations of the keyboard assembly when the key (the white key) is depressed in the first embodiment. FIG. 8A illustrates a state in which the key 100 is located at the rest position (that is, the key 100 is not depressed). FIG. 8B illustrates a state in which the key 100 is located at the end position (that is, the key 100 is fully depressed). When the key 100 is pressed, the rod-like flexible member 185 is bent as a pivot center. In this movement, the rod-like flexible member 185 is bent toward a front side of the key 100 (in the front direction), but movement of the rod-like flexible member 185 in the front and rear direction is limited by the side-surface key guide 153, whereby the key 100 does not move frontward but pivots in a pitch direction. The key-side load portion 120 depresses the hammer-side load portion 210, causing pivotal movement of the hammer assembly 200 about the pivot shaft 520. In the explanation for FIGS. 8A and 8B, FIGS. 4-5E are referred for the configuration of the sliding-surface forming portion 121 of the key-side load portion 120.

In the pivotal movement of the hammer assembly 200, the weight 230 is moved upward. Thus, the weight of the weight 230 applies a force to the key 100 so as to move the key 100 toward the rest position (upward). In the load generator (the key-side load portion 120 and the hammer-side load portion 210), the moving member 211 elastically deforms the upper member 1211 during movement in contact with the sliding surface FS, whereby the moving member 211 receives various resisting forces in accordance with a method of key pressing. The resisting forces and the weight of the weight 230 appear as load on key pressing. Also, the moving member 211 moves over the step 1231, whereby a click feel is transferred to the key 100. Here, the click feel is a touch feel constituted by a collision feel and a subsequent falling feel which are given by an operation of an escapement mechanism provided in acoustic pianos, in accordance with the speed of key pressing with a finger of the player.

When the weight 230 collides against the upper stopper 430, the pivotal movement of the hammer assembly 200 is stopped, and the key 100 reaches the end position. In this operation, an inertial force caused by pivotal movement of the hammer assembly 200 in some cases causes the moving member 211 to be continued to move and collide against the guide surface GS. Also in this case, since the guide surface GS is easily deformed due to the small area of contact between the moving member 211 and the guide surface GS (the protruding portions 1235), it is possible to reduce a collision sound and a wobbling feel. When the sensor 300 is deformed by the sensor driving member 215, the sensor 300 outputs the detection signals in accordance with a plurality of levels of an amount of deformation of the sensor 300 (i.e., the key pressing amount).

When the key 100 is released, the weight 230 moves downward, causing pivotal movement of the hammer assembly 200. With the pivotal movement of the hammer assembly 200, the key 100 pivots upward via the load generator. When the weight 230 comes into contact with the lower stopper 410, the pivotal movement of the hammer assembly 200 is stopped, and the key 100 is returned to the rest position. In this movement, the moving member 211 is returned to the initial position. The moving member 211 in some cases bounds to the sliding surface FS and collides against the guide surface GS. Also in this case, since the guide surface GS is easily deformed due to the small area of contact between the moving member 211 and the guide surface GS (the protruding portions 1235), it is possible to efficiently absorb impact to reduce a collision sound and a wobbling feel.

Second Embodiment

There will be next described examples of the shape of the protruding portion 1235 provided on the lower member 1213 in a second embodiment which are different from the shape of the protruding portion 1235 in the first embodiment.

FIGS. 9A-9E are views for explaining the examples of the shape of the protruding portion provided on the lower member in the second embodiment. FIGS. 9A-9E are illustrated so as to correspond to FIG. 5(B) explained in the description for the first embodiment. As in FIGS. 5A-5E, a region in which the moving member 211 and the rib 213 are provided are indicated by the two-dot chain line in each of FIGS. 9A-9E.

Figure 9A:
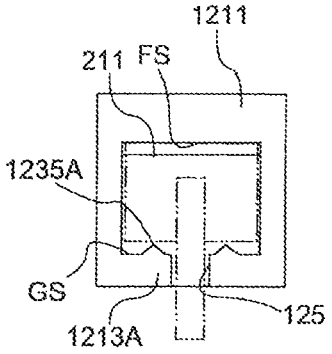
FIGS. 9A through 9E are views for explaining examples of the shape of a protruding portion provided on a lower member in a second embodiment.

In a first example illustrated in FIG. 9A, a guide surface GS of a lower member 1213A has surfaces parallel with the sliding surface FS, at regions other than a protruding portions 1235A. In the case where the protruding portions 1235A are viewed in the direction in which the slit 125 extends (in the case where the protruding portions 1235A are viewed along the traveling direction D1 of the moving member 211 as in the states illustrated in 9A-9E (this applies to other figures)), the shape of each of the protruding portions 1235A is a triangle having a top at its portion nearest to the sliding surface FS. While one side surface of each of the protruding portions 1235 serves as a corresponding one of side surfaces of the slit 125 in the first embodiment, the surfaces parallel with the sliding surface FS are provided each between the slit 125 and a corresponding one of the protruding portions 1235A in this example.

Figure 9B:
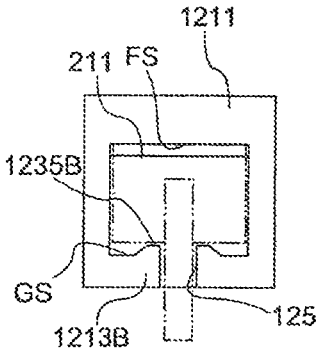

In a second example illustrated in FIG. 9(B), a guide surface GS of a lower member 1213B has surfaces parallel with the sliding surface FS, at regions other than a protruding portions 1235B. In the case where the protruding portions 1235B are viewed in the direction in which the slit 125 extends, the shape of each of the protruding portions 1235B is a trapezoid parallel with the sliding surface FS, at a portion of the trapezoid which is nearest to the sliding surface FS.

Figure 9C:
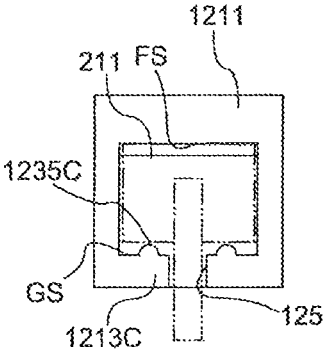

In a third example illustrated in FIG. 9C, a guide surface GS of a lower member 1213C has surfaces parallel with the sliding surface FS, at regions other than a protruding portions 1235C. In the case where the protruding portions 1235C are viewed in the direction in which the slit 125 extends, the shape of each of the protruding portions 1235C is an arc shape. The center of this arc is preferably located on the guide surface GS or a position located below the guide surface GS (on an opposite side of the guide surface GS from the sliding surface FS).

Figure 9D:
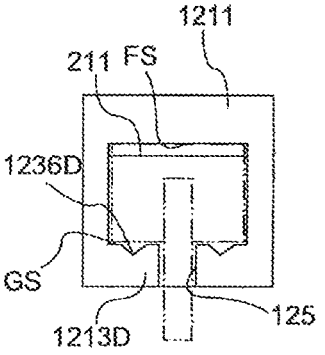

In a fourth example illustrated in FIG. 9D, depressed portions 1236D shaped like grooves are formed in a guide surface GS of a lower member 1213D along the slit, i.e., along the traveling direction D1. The depressed portions 1236D are formed on opposite sides of the slit 125. In the case where the depressed portions 1236D are viewed in the direction in which the slit 125 extends, the shape of each of the depressed portions 1236D is a triangle having a top at its portion farthest from the sliding surface FS. These depressed portions 1236D also make the area of contact between the moving member 211 and the guide surface GS smaller than the area of contact between the moving member 211 and the sliding surface FS.

Figure 9E:
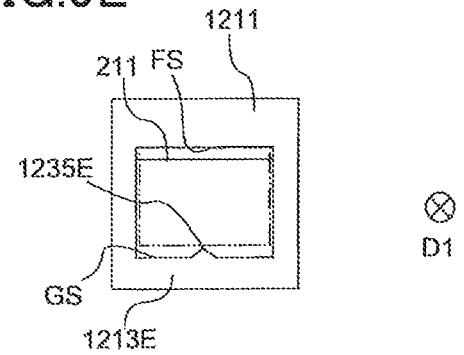

In a fifth example illustrated in FIG. 9E, the slit 125 is not formed in a lower member 1213E. In the case where the lower member 1213E is viewed along the traveling direction D1 of the moving member 211, a protruding portion 1235E protrudes from a central portion of the lower member 1213E (at a position of the slit in the other examples). In the case where the protruding portion is viewed in the traveling direction D1 of the moving member 211, the shape of the protruding portion 1235E is a triangle having a top at its portion nearest to the sliding surface FS.

The protruding portion may have any of various shapes other than those in the above-described examples. For example, the protruding portion is not limited to a portion extending in a straight line along the traveling direction D1 of the moving member 211 and may have a curve or curves such as a wave, for example. The protruding portion may not be provided throughout a region in which the moving member 211 is moved and may be provided only at a portion of the region in which the moving member 211 is moved. In the case where the protruding portion is provided only at a portion of the region in which the moving member 211 is moved, the protruding portion may be provided at a region at which the moving member 211 easily contacts the guide surface GS. One example of this region is opposite end portions of the region in which the moving member 211 is moved (positions of the moving member 211 when the key 100 is located at the rest position and the end position, respectively).

In the case where the protruding portion or portions are viewed along the traveling direction D1 of the moving member 211, the protruding portion or portions may be symmetric or asymmetric about the center of the moving member 211 (the position of the rib 213). The number of the protruding portions may be one as illustrated in FIG. 9E, two as illustrated in FIGS. 9A through 9D, or more. In the case where the protruding portions are provided, the shape of any of the protruding portions may be different from that of another of the protruding portions.

Third Embodiment

There will be next described examples of a configuration in which the protruding portion or portions protrude from the moving member 211 in a third embodiment instead of the configuration in which the protruding portion or portions 1235 protrude from the lower member 1213.

Figure 10A:
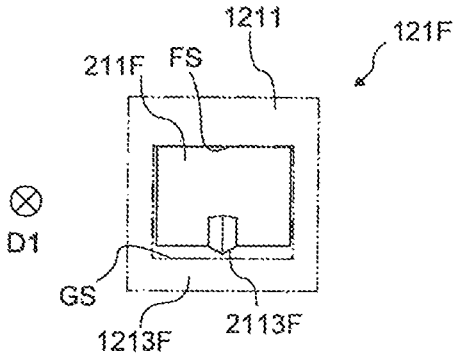
FIGS. 10A and 10B are views for explaining a first example of the shape of a protruding portion provided on a moving member in a third embodiment.
Figure 10B:
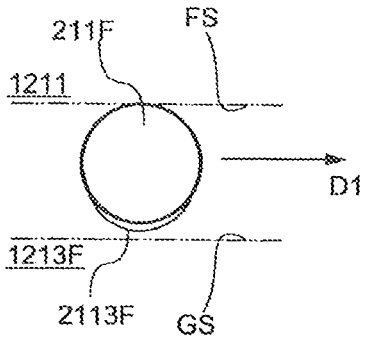

FIGS. 10A and 10B are views for explaining a first example of the shape of the protruding portion provided on the moving member in the third embodiment. FIG. 10A is a view when viewed in a direction corresponding to that in FIG. 5(B) explained in the description for the first embodiment. That is, FIG. 10A is a view when viewed along the traveling direction D1 of the moving member. FIG. 10B is a view when the moving member is viewed in a direction along the scale direction. It is noted that a region in which a sliding-surface forming portion 121F (the upper member 1211, a lower member 1213F, and the side member 1215) is provided is indicated by the two-dot chain lines. This example has no configuration corresponding to the rib 213 and the slit 125 in the first embodiment. This applies to FIGS. 11A and 11B which will be described below.

A moving member 211F has a circular cylindrical shape and has a protruding portion 2113F protruding toward the guide surface GS. The protruding portion 2113F protrudes in a line from the moving member 211F along the traveling direction D1. In other words, the protruding portion 2113F protrudes in a line toward the lower member 1213F from a lower portion of an outer circumferential surface of the moving member 211F shaped like a circular cylinder. In this example, in the case where the moving member 211F is viewed in the direction indicated in FIG. 10A, that is, the moving member 211F is viewed in a direction along the traveling direction D1 of the moving member 211F, the shape of the protruding portion 2113F is a triangle having a top at its portion nearest to the lower member 1213F. In this example, as illustrated in FIG. 10B, an amount of protrusion of the protruding portion 2113F with respect to the moving member 211F is different among positions in the radial direction of the circle. It is noted that the protruding portion 2113F may have any of various shapes as in the examples of the second embodiment. When the moving member 211F is in contact with the sliding surface FS, the protruding portion 2113F is separated from the guide surface GS. When the protruding portion 2113F is in contact with the guide surface GS, the moving member 211F is separated from the sliding surface FS.

Thus, the protruding portion 2113F of the moving member 211F can also reduces the area of contact between the moving member 211F and the lower member 1213F. Unlike the above-described embodiments, the lower member 1213F is elastically deformed without the protruding portion 2113F being elastically deformed. Thus, the presence of the protruding portion 2113F concentrates a force at a portion of the lower member 1213F, which increases a degree of the elastic deformation, enabling efficient absorption of impact.

Figure 11A:
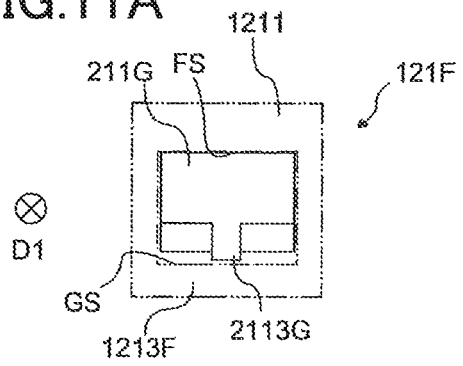
FIGS. 11A and 11B are views for explaining a second example of the shape of the protruding portion provided on the moving member in the third embodiment.
Figure 11B:
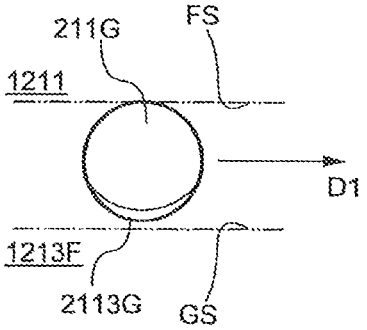

FIGS. 11A and 11B are views for explaining a second example of the shape of the protruding portion provided on the moving member in the third embodiment. The sliding-surface forming portion 121F is the same as that in the example illustrated in FIGS. 10A and 10B. A moving member 211G has such a shape that a portion of the circular cylindrical shape is removed so as to leave a protruding portion 2113G. That is, an outer circumferential portion of the moving member 211G and the protruding portion 2113G forms a side shape of the circular cylinder. Thus, the protruding portion 2113G protrudes in a line from the moving member 211G along the traveling direction D1. In other words, the protruding portion 2113G has such a shape that a lower portion of an outer circumferential surface of the moving member 211G having a circular cylindrical shape is removed so as to leave the protruding portion 2113G, and the protruding portion 2113G protrudes in a line shape toward the lower member 1213F from a portion of the outer circumferential surface of a lower portion of the moving member 211G.

Figure 12:
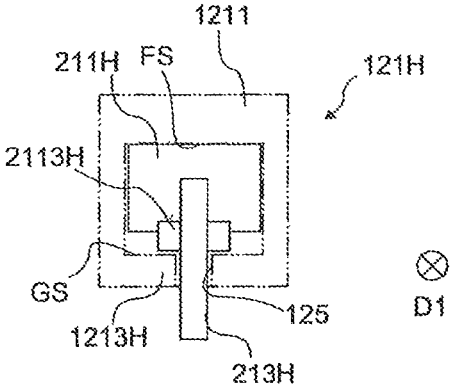
FIG. 12 is a view for explaining a third example of the shape of the protruding portion provided on the moving member in the third embodiment.

FIG. 12 is a view illustrating a third example of the shape of the protruding portion provided on the moving member in the third embodiment. In this example, a rib 213H is connected to a moving member 211H. Thus, a lower member 1213H of a sliding-surface forming portion 121H has the slit 125. Protruding portions 2113H protrude from the moving member 211H toward the guide surface GS and are connected to the rib 213H. The protruding portions 2113H are formed on opposite sides of the rib 213H. It is noted that the protruding portions 2113H may have a shape in which the protruding portions 2113H are connected only to the rib 213H without being directly connected to the moving member 211H. Alternatively, the protruding portions 2113H may have a shape in which the protruding portions 2113H are connected only to the moving member 211H without being directly connected to the rib 213H.

It is noted that each of the protruding portions may have any of various shapes other than those in the above-described examples. For example, the protruding portion is not limited to a portion extending in a straight line along the traveling direction D1 of the moving member 211 and may have a curve or curves such as a wave, for example. In the case where the protruding portions are viewed along the traveling direction D1 of the moving member 211, the protruding portions may be symmetric or asymmetric about the center of the moving member 211 (the position of the rib 213). The number of the protruding portions may be one as illustrated in FIGS. 10A-11B, two as illustrated in FIG. 12, or more. In the case where the protruding portions are provided, the shape of any of the protruding portions may be different from that of another of the protruding portions.

Fourth Embodiment

There will be next described examples of a configuration in which a moving member contacts both of the sliding surface FS and a protruding portion of the guide surface GS in a fourth embodiment.

Figure 13A:
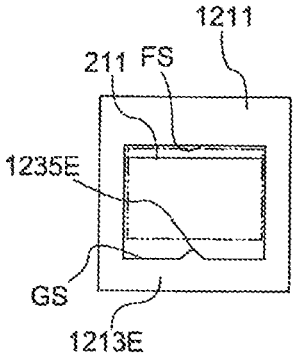
FIGS. 13A and 13B are views for explaining a relationship between a moving member and a protruding portion provided on a lower member in a fourth embodiment.
Figure 13B:
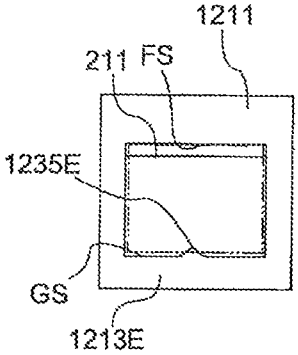

FIGS. 13A and 13B are views for explaining a relationship between the moving member and the protruding portion provided on the lower member in the fourth embodiment. FIG. 13A corresponds to FIG. 9E explained in the description for the second embodiment. FIG. 13B illustrates an example of a configuration in which the moving member 211 not only contacts the sliding surface FS but also always contacts the protruding portion 1235E of the guide surface GS in the configuration in FIG. 13A. In this configuration, as illustrated in FIG. 13B, the moving member 211 is in contact only with the protruding portion 1235E without contacting a surface of the guide surface GS which is parallel with the sliding surface FS. In this case, the protruding portion 1235E is elastically deformed by the moving member 211. Even in the case where the moving member 211 receives a force in a direction directed toward the guide surface GS, the moving member 211 preferably does not contact the entire guide surface GS by an elastic force of the protruding portion 1235E.

In this case, if the size of the moving member 211 is unexpectedly changed for reasons of manufacturing, an amount of elastic deformation of the protruding portion 1235E changes. However, since the area of contact is small, it is possible to reduce effects on a force of resistance to movement of the moving member 211.

Fifth Embodiment

There will be next described examples of a configuration in which a moving member contacts the sliding surface FS, and a protruding portion of the moving member contacts the guide surface GS in a fifth embodiment.

Figure 14A:
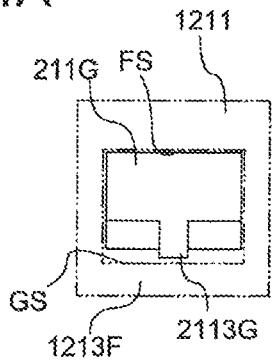
FIGS. 14A and 14B are views for explaining a relationship between a lower member and a protruding portion provided on a moving member in a fifth embodiment.
Figure 14B:
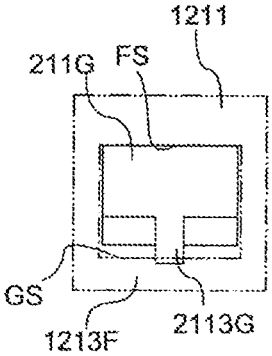

FIGS. 14A and 14B are views for explaining a relationship between a lower member and the protruding portion provided on the moving member in the fifth embodiment. FIG. 14A corresponds to FIG. 11A explained in the description for the third embodiment. FIG. 14B illustrates an example of a configuration in which not only the moving member 211G contacts the sliding surface FS, but also the protruding portion 2113G of the moving member 211G always contacts the guide surface GS in the configuration in FIG. 14A. In this configuration, as illustrated in FIG. 14B, only the protruding portion 2113G contacts the guide surface GS, and the other portion of the moving member 211G does not contact the guide surface GS. In this case, the guide surface GS is elastically deformed by the protruding portion 2113G. Even in the case where the moving member 211G receives a force in a direction directed toward the guide surface GS, portions of the moving member 211G other than the protruding portion 2113G preferably do not contact the guide surface GS by an elastic force applied from the guide surface GS to the protruding portion 2113G.

In this case, if the size of the moving member 211 is unexpectedly changed for reasons of manufacturing, an amount of elastic deformation of the guide surface GS caused by the protruding portion 2113G changes. However, since the area of contact is small, it is possible to reduce effects on a force of resistance to movement of the moving member 211G.

Sixth Embodiment

In a sixth embodiment, the key 100 and the key-side load portion 120 are indirectly connected to each other.

Figure 15A:
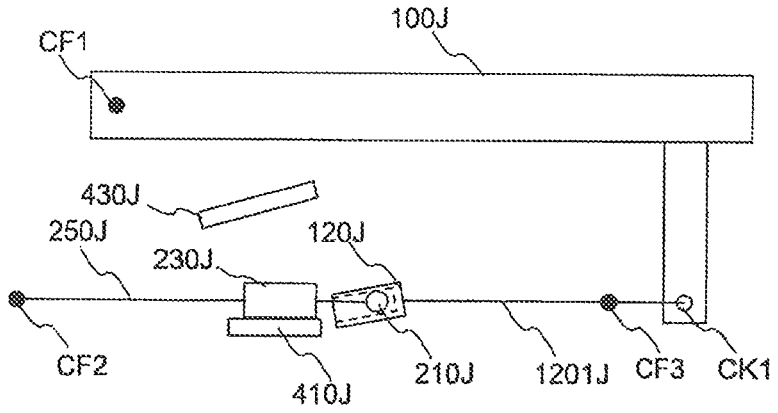
FIGS. 15A and 15B are views for schematically explaining a relationship in connection between a key and a hammer of a keyboard assembly in a sixth embodiment.
Figure 15B:
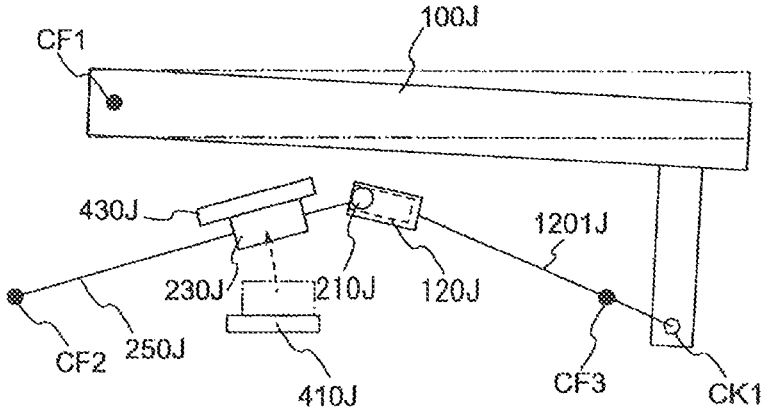

FIGS. 15A and 15B are views for schematically explaining a relationship in connection between the key and a hammer of the keyboard assembly in the sixth embodiment. FIGS. 15A and 15B schematically represent a relationship among the key, the weight, and the load generator. FIG. 15A is a view when a key 100J is located at the rest position before the key 100J is pressed. FIG. 15B is a view when the key 100J is located at the end position after the key 100J is pressed.

The key 100J pivots about the center CF1. The center CF1 corresponds to the rod-like flexible members 185 in the above-described embodiment, for example. A key-side load portion 120J and the key 100J are connected to each other by a structure 1201J. The structure 1201J pivots about the center CF3. One end of the structure 1201J is rotatably connected to the key 100J by a linkage mechanism CK1. The other end of the structure 1201J is connected to the key-side load portion 120J. A hammer body 250E pivots about the center CF2. The center CF2 corresponds to the pivot shaft 520 in the above-described embodiment. A weight 230J is disposed between the center CF2 and a hammer-side load portion 210J.

With this configuration, when the key 100J is pressed, the hammer-side load portion 210J moving in the key-side load portion 120J moves the weight 230J upward until the key-side load portion 120J collides against an upper stopper 430J. That is, the state of the key 100 and the key-side load portion 120 is changed from the state illustrated in FIG. 15A to the state illustrated in FIG. 15B. When the key 100 is released, the weight 230J is moved downward to press the key 100J upward until the weight 230J collides against a lower stopper 410J. That is, the state of the key 100 and the key-side load portion 120 is changed from the state illustrated in FIG. 15B to the state illustrated in FIG. 15A. Thus, as long as the load generator is provided in a path of transfer of a force from the key to the hammer assembly, at least one of the key and the hammer assembly may be directly or indirectly connected to the load generator, enabling various configurations.

Modifications

While the embodiments have been described above, the disclosure may be embodied with various changes and modifications.

While the sensor driving member 215 is connected to the moving member 211 via the rib 213 in the above-described embodiments, the rib 213 may be omitted. In this configuration, the moving member 211 and the sensor driving member 215 at least have to be connected to the hammer body 250. The slit 125 may not be formed in the lower member 1213 in this configuration.

While the entire sliding-surface forming portion 121 is formed of an elastic material in the above-described embodiments, the present disclosure is not limited to this configuration. For example, an elastic member may be disposed on the entire region in which the sliding surface FS is formed. Only the protruding portion formed on the guide surface GS may be formed of an elastic material. To obtain the resisting forces against key pressing described in the first embodiment, a region in which the moving member 211 is contactable with the sliding surface FS is preferably formed of at least an elastic material in the entire range in which the key 100 is movable. It is noted that, even if the protruding portion is not formed of an elastic material at the sliding-surface forming portion, the smaller area of contact between the protruding portion and the moving member reduces collision sounds. In the case where the moving member has the protruding portion, this protruding portion may be formed of an elastic material.

While the key-side load portion 120 containing the sliding surface FS is connected to the key 100, and the hammer-side load portion 210 containing the moving member 211 is connected to the hammer assembly 200 in the above-described embodiments, this relationship may be reversed. In the case where this relationship is reversed, specifically, the sliding surface FS is formed on the hammer-side load portion 210, and the key-side load portion 120 includes the moving member 211. That is, this keyboard apparatus 1 only needs to be configured such that one of the moving member 211 and the sliding surface FS is connected to the key 100, and the other is connected to the hammer assembly 200.

A portion or the entirety of the region of the lower member 1213 (the guide surface GS) may be omitted. In the case where the region is partly left, the guide surface GS at least needs to be left on a region in which the moving member 211 easily collides against the guide surface GS. For example, immediately after the key 100 is pressed to the end position, the hammer assembly 200 is kept rotated by an inertial force, whereby the moving member 211 is easily moved off the sliding surface FS. Immediately after the key 100 is returned to the rest position, when the hammer assembly 200 is kept rotated by an inertial force, the moving member 211 in some cases collides with and bounces off the sliding surface FS. In these situations, the moving member 211 easily contacts the guide surface GS. That is, the guide surface GS is preferably disposed at least at opposite end portions of the region in which the moving member 211 is movable. In this case, the protruding portions 1235 at least need to be formed at positions on the guide surface GS.

The step 1231 may be omitted from the sliding surface FS. In this configuration, the click feel is preferably generated using another method. The click feel may not be generated at least in the load generator. Even in the case where the click feel is not generated, the load generator may use elastic deformation of the sliding surface FS to apply a force of resistance to key pressing.

What is claimed is:

1. A keyboard apparatus, comprising:

a key disposed so as to be pivotable with respect to a frame;

a hammer assembly disposed so as to be pivotable in response to pivotal movement of the key;

a first member;

a second member disposed so as to be slid and moved on the first member when the hammer assembly pivots in response to pivotal movement of the key; and a third member connected to the first member and configured to guide the second member such that the second member is not located at a distance greater than or equal to a predetermined distance from the first member, the third member having a shape in which a second contact area that is an area of contact between the second member and the third member is less than a first contact area that is an area of contact between the first member and the second member.

2. The keyboard apparatus according to claim 1, wherein the second member comprises a protruding portion protruding toward the third member and extending in a line shape along a direction of movement of the second member.

3. The keyboard apparatus according to claim 2, wherein the second member comprises a plurality of the protruding portions.

4. The keyboard apparatus according to claim 1, wherein the third member is formed with a slit through which a rib configured to be moved with the second member passes.

5. The keyboard apparatus according to claim 4, wherein the plurality of the protruding portions are disposed on opposite sides of the rib.

6. The keyboard apparatus according to claim 2, wherein the protruding portion of the second member is separated from the third member when the second member is in contact with the first member.

7. The keyboard apparatus according to claim 1, wherein the third member comprises a protruding portion protruding toward the second member and extending in a line shape along a direction of movement of the second member.

8. The keyboard apparatus according to claim 7, wherein the third member comprises a plurality of the protruding portions.

9. The keyboard apparatus according to claim 8, wherein the third member is formed with a slit through which a rib configured to be moved with the second member passes, and wherein the plurality of protruding portions are disposed on opposite sides of the slit.

10. The keyboard apparatus according to claim 7, wherein the protruding portion of the third member is separated from the second member when the second member is in contact with the first member.

11. The keyboard apparatus according to claim 1, wherein the third member comprises a depressed portion depressed in a direction away from the second member and having a shape extending along a direction of movement of the second member.

12. The keyboard apparatus according to claim 11, wherein the third member comprises a plurality of the depressed portions.

13. The keyboard apparatus according to claim 12, wherein the third member is formed with a slit through which a rib configured to be moved with the second member passes, and wherein the plurality of the depressed portions are disposed on opposite sides of the slit.

14. The keyboard apparatus according to claim 1, wherein the third member is configured to be slid relative to the second member when the hammer assembly pivots in response to pivotal movement of the key.

15. The keyboard apparatus according to claim 1, wherein one of the first member and the second member is connected to the key, and the other is connected to the hammer assembly.

16. The keyboard apparatus according to claim 1, wherein the hammer assembly comprises a weight, and wherein the first member is configured to, when the key is pressed, allow sliding of the second member on the first member and apply a force to the second member so as to move the weight upward.

17. The keyboard apparatus according to claim 16, wherein the first member is disposed for the key at a position at which the first member is moved downward when the key is pressed, and wherein the second member is connected to the hammer assembly on an opposite side of a pivot axis of the hammer assembly from the weight such that the weight is moved upward when the second member is pressed downward by the first member.

18. The keyboard apparatus according to claim 17, wherein the third member is disposed for the key such that the second member is interposed between the third member and the first member.

19. The keyboard apparatus according to claim 4, wherein the slit is formed in the third member along a direction of movement of the second member.

20. The keyboard apparatus according to claim 4, wherein the slit extends, at an end portion of the third member in a direction of movement of the second member, through the third member toward a side on which the rib is located.

21. The keyboard apparatus according to claim 4, further comprising a plate member connected to the rib on an opposite side of the third member from the second member.

22. The keyboard apparatus according to claim 21, further comprising a sensor configured to receive a force from the plate member in response to pressing of the key.

23. The keyboard apparatus according to claim 7, wherein the protruding portion is inclined so as to be nearer to the first member at a portion of the protruding portion near the slit than at a portion of the protruding portion far from the slit.

* * * * *